United States Patent [19]

Dinan

[11] Patent Number: 4,890,403

[45] Date of Patent: Jan. 2, 1990

[54] POLE SIGN CONSTRUCTION

[75] Inventor: James M. Dinan, Irvington, N.Y.

[73] Assignee: Dinaco, Inc., Irvington-on-Hudson, N.Y.

[21] Appl. No.: 231,727

[22] Filed: Aug. 12, 1988

[51] Int. Cl.[4] ..... G09F 17/00

[52] U.S. Cl. ..... 40/604; 40/607

[58] Field of Search ..... 40/603, 606, 607, 604

[56] References Cited

U.S. PATENT DOCUMENTS

| | | | |
|---|---|---|---|
| 3,217,690 | 11/1965 | Mihalisin | 40/604 |
| 3,310,889 | 3/1967 | Hart et al. | 40/604 |
| 3,500,789 | 3/1970 | Keats | 40/604 |
| 3,537,201 | 11/1970 | Huey et al. | 40/604 |
| 3,550,297 | 12/1970 | Friedrichsen | 40/603 |
| 3,683,527 | 8/1972 | Gilman | 40/604 |
| 3,824,725 | 7/1974 | Friedrichsen | 40/604 |
| 3,831,304 | 8/1974 | Miller et al. | 40/604 |

*Primary Examiner*—Gene Mancene
*Assistant Examiner*—Michael Lynch
*Attorney, Agent, or Firm*—Schweitzer & Cornman

[57] ABSTRACT

A new and improved pole sign consisting of several simple but effective elements, namely, a one-piece upper sign engaging framing unit; an identical lower sign-engaging frame unit; and a laminated, flexible roll-up sign of sheet material which is gripped and mounted at its upper and lower edges in the aforementioned frame units; and a conventional strap mount for affixing said upper and lower frame units to a vertical pole. Where back-to-back units are desired for mounting on the same pole, the strap hardware simply affixes a pair of upper frame members and a pair of lower frame members in tandem to the mounting pole. The frame members are made of injection molded structual foam and include an inner rigid base member extending horizontally for the width of the sign to be displayed and having a mounted channel extending for its length, to which a corresponding clamping member is integrally hinged so as to be openable and closeable with respect to said underlying member and to nest within the full width groove of the member.

3 Claims, 2 Drawing Sheets

FIG. 1
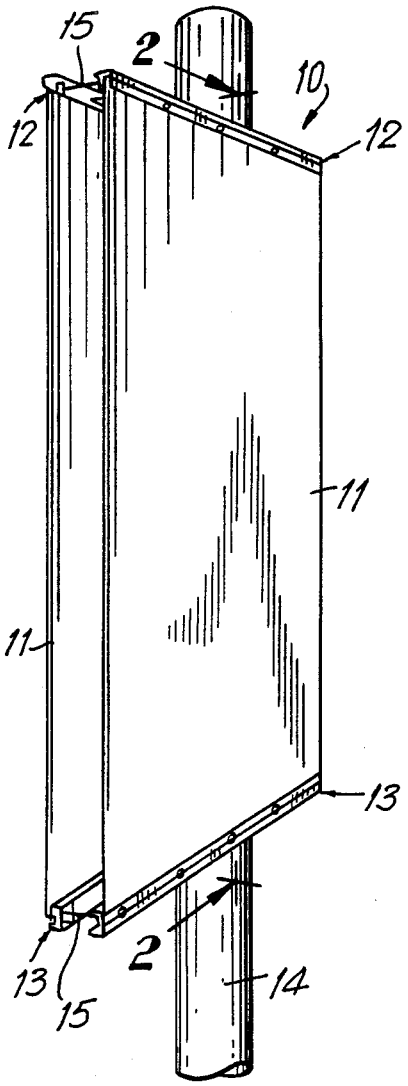
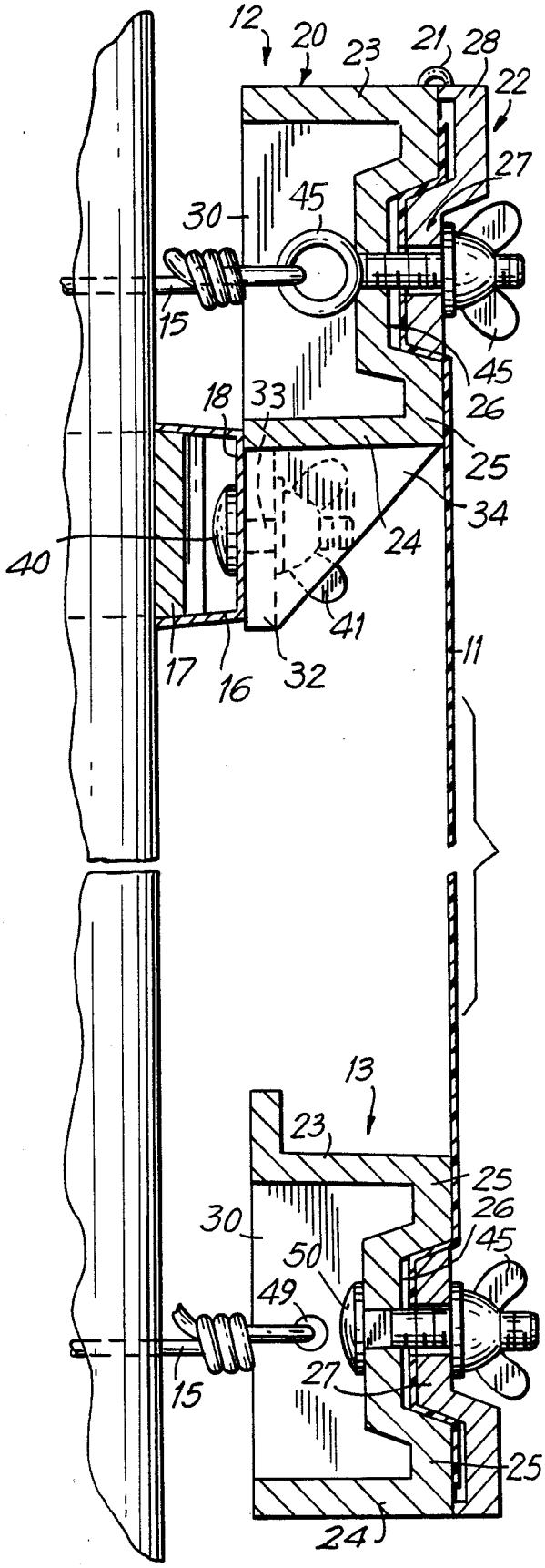
FIG. 2

POLE SIGN CONSTRUCTION

BACKGROUND OF THE INVENTION

The present invention relates in general to framed display signs for use outdoors and, more particularly, for use in automotive filling stations.

The construction of the present invention is particularly well suited for signs, which are displayed outdoors, requiring changes from time to time to reflect new prices, new products, or other new messages. Heretofore, these type of signs have been mounted on display racks and/or on vertical poles in prominent positions so as to be readily viewed by the motoring public. It is desired that signs of this general type be replaced simply and easily and at low cost so as to display new and/or more current advertising messages as the need arises. In addition, it is important that signs of this type be capable of low cost manufacture and sale at reasonable costs to the ultimate marketing consumer, and that the advertising messages to be mounted in the signs be changeable quickly, easily, and without the requirements of high skilled labor or the requirements of special tooling.

The changeable sign messages themselves have heretofore been printed on cloth, reinforced papers and plastics films. Whatever the particular medium of the sign, it is critical that it be capable of withstanding the effects of weather, i.e., extremes in temperature, precipitation, as well as high winds.

The present invention provides a new and improved sign, especially well suited for pole mounting, which satisfies to great advantage all of the foregoing criteria. It will be appreciated from the following summary of the invention and detailed description of the same that the new display sign of the inventon provides for readily replaceable displays of a single or back-to-back advertising panels on a single pole, which advertising panels may be replaced quickly and simply without skilled labor or special tools, and which sign is rigid while being light based and of low cost.

SUMMARY OF THE PRESENT INVENTION

The new and improved pole sign of the present invention consists of several simple but effective elements, namely, a one-piece upper sign engaging framing unit; an identical lower sign-engaging frame unit; and a laminated, flexible roll-up sign of sheet material which is gripped and mounted at its upper and lower edges in the aforementioned frame units; and a conventional strap mount for affixing said upper and lower frame units to a vertical pole. Where back-to-back units are desired for mounting on the same pole, the strap hardware simply affixes a pair of upper frame members and a pair of lower frame members in tandem to the mounting pole.

In accordance with the principles of the present invention, the frame members are made of injection molded structual foam and include an inner rigid base member extending horizontally for the width of the sign to be displayed and having a mounted channel extending for its length, to which a corresponding clamping member is integrally hinged so as to be openable and closeable with respect to said underlying member and to nest within the full width groove of the member.

DESCRIPTION OF THE DRAWINGS

FIG. 1 is a perspective view of the new and improved display sign of the invention mounted in back-to-back relationship on the vertical pole;

FIG. 2 is an fragmentary cross-sectional view taken along line 2—2 of FIG. 1.

DETAILED DESCRIPTION OF THE INVENTION

Figure 3:
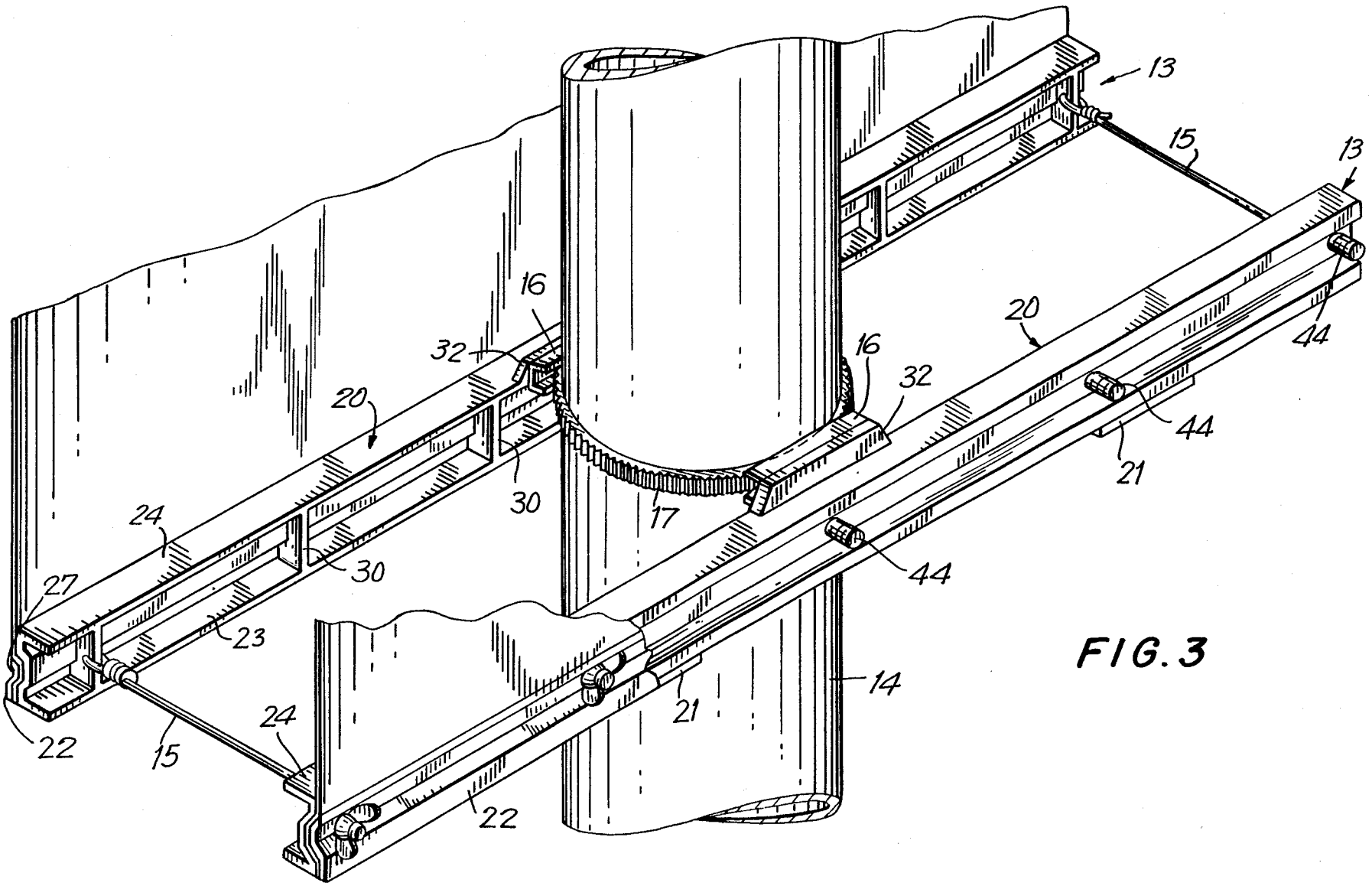
FIG. 3 is an enlarged, fragmentary perspective view showing details of construction of the frame members and mounting hardware of the new and improved display sign.

Referring now to FIG. 1, the new and improved sign construction 10 is in the form of a laminated plastic billboard sheet 11 which is unrolled to display an advertising message thereon as will be understood, which display film sheet is held tautly and rigidly at its upper and lower edges by an upper frame unit 12 and a lower frame unit 13 of identical construction. An identical billboard sheet 11 is supported on the opposite side of the mounting pole 14 by a second pair of upper and lower frame units 12, 13, as shown in FIG. 1. The upper frame units 12 and lower frames units 13 are braced on to the other by intermediate taut cords or wires 15 in a manner to be disclosed more specifically hereinafter.

The opposed frame units 12 and 13, as shown in FIG. 3, are mounted to the pole 14 to mounting blocks 16 attached to the pole by flexible metal straps 17 which are cinched tightly to the pole, as will be understood. As shown in FIG. 2, the mounting block 16 is formed from a steel channel having a generally U-shaped cross section and having a mounting wall 18 which extends parallel to the frame units 12 and 13, as will be understood and as is shown in FIG. 2 and FIG. 3.

In accordance with the invention, the frame units 12, 13 are injection molded from structural foam in single units comprising three elements integrated together as follows. A longitudinal rail 20, an integral set of hinges 21 and a clamping member 22 are formed together at the same time in a single mold. More specifically, the rail 20 includes parallel side walls 23, 24 bridged by a top wall 25, having a recessed trapezoidal groove 26 formed therein. The clamping unit 22 includes a cantilevered trapezoidal clamping head 27 mounted on the distal end of an arm 28 which is pivotable about the intersection of top wall 25 and side wall 23. The walls 23, 24 are braced by spaced flanges 30 which rigidify the frame units 12, 13 through their extended length.

At the center of the rails 12, 13 and projecting upwardly from the inner edge of the wall 20 in a vertical plane is a mounting flange 32 having a series a holes 33 formed therein. Triangular reinforcing webs 34 further rigidify the rails 12 and 13 and extend between the mounting flange 32 and the vertical walls 24, as shown in FIG. 2.

The new display sign construction of the invention is completed and mounted to the vertical support pole 14 as follows. The frames 12 and 13 are bolted to the horizontally extended walls 18 of the mounting channels 16 which are strapped to the pole by straps 17, as shown in FIG. 3 and 2 through bolts 40 which project through the walls 18 and through the holes 33 formed in the mounting flanges 32. Wing nuts 41 are tightened to the bolt to secure the frame rails 12 and 13 to the mouting walls 18. The display signs 11 containing the graphics which are to be exhibited on the pole are clamped into place at the top and bottom rails 12 and 13 by pivoting the clamping members 22 over the film 11, which film is suitably perforated to allow mounting bolts 44 to project therethrough, as shown in FIG. 2. Advantageously, the bolts 44 include an eye head 45, as shown in FIG. 2, at the upper portions thereof. More specifically, the eye bolt may be molded into the frame units 12, 13 or otherwise permanently secured thereto. Wing nuts 45 may be tightened down to clamp the upper and lower edges of the film 11 into the trapezoidal channel 26, as shown. Opposed eyes 45 may be braced one to the other by the tensioning cords or wires 15 as shown in the upper portions of FIG. 2. If desired, the tensioning members 15 may alternatively be connected directly to the rails 12, 13 through openings 49 formed in opposed flange members 30, as shown in the lower portions of FIG. 2. In such case, a standard bolt 50 will be employed in lieu of the eye bolt 45.

As will be appreciated, the film 11 may be readily and simply changed when desired by unscrewing the wing nuts 45 hinging the clamping members through the spaced integral hinges 21 to open the frame unit for removal of the film sign 11 to be replaced. A new film 11 may then be slipped over the projecting bolts 44; the clamping member 22 may then be pivoted back into clamping engagement of the upper and lower ends of the film 11 in the trapezoidal locking channels 26 and the wing nuts may thereafter be tightened down to clamp the new sign in place.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim

1. A pole sign construction comprising (a) a vertical pole member, (b) upper and lower identical frame rail members mounted in spaced relation to one another on said pole, (c) said frame rail members comprising an elongated structural foam member having a trapezoidal channel formed in an outer wall thereof, having a mating trapezoidal member hinged thereto by spaced hinging straps integrally formed therebetween, said clamping member being pivotable with respect to said rail member to selectively engage the free ends of a flexible film sign, and (d) said frame rail means further include bolt means mounted in and projecting through said channel means and said clamping means, (e) threaded nut means associated with said bolt means for securely locking said clamping means against said channel means.

2. A pole sign in accordance with claim 1, in which (a) pairs of upper and lower frame rails are supported on said pole unit, (b) guide wire means are secured to each of said opposed rail units in tightened fashion to brace the same.

3. The pole unit of claim 1, further characterized in that (a) said bolt means includes an eye head, (b) said tensioning means is affixed to said eye head.

* * * * *